US005966567A

United States Patent [19]

Matsuzaki et al.

[11] Patent Number: 5,966,567

[45] Date of Patent: Oct. 12, 1999

[54] PROCESS CARTRIDGE AND ELECTROPHOTOGRAPHIC IMAGE FORMING APPARATUS

[75] Inventors: Hiroomi Matsuzaki, Mishima; Shigeo Miyabe, Numazu; Akira Suzuki, Odawara; Kazuo Chadani, Shizuoka-ken, all of Japan

[73] Assignee: Canon Kabushiki Kaisha, Tokyo, Japan

[21] Appl. No.: 08/985,211

[22] Filed: Dec. 4, 1997

[30] Foreign Application Priority Data

Dec. 12, 1996 [JP] Japan ..... 8-352187

[51] Int. Cl.[6] ..... G03G 21/16; G03G 21/18

[52] U.S. Cl. ..... 399/111; 399/113

[58] Field of Search ..... 399/111, 113, 399/123, 110, 107

[56] References Cited

U.S. PATENT DOCUMENTS 5,294,960 3/1994 Nomura et al. ..... 399/113
5,331,373 7/1994 Nomura et al. .
5,452,056 9/1995 Nomura et al. .
5,463,446 10/1995 Watanabe et al. .
5,585,889 12/1996 Shishido et al. .
5,640,650 6/1997 Watanabe et al. .
5,749,027 5/1998 Ikemoto et al. ..... 399/113

*Primary Examiner*—Susan S.Y. Lee
*Attorney, Agent, or Firm*—Fitzpatrick, Cella, Harper & Scinto

[57] ABSTRACT

A process cartridge removably mounted on a main body of an electrophotographic image forming includes an electrophotographic photosensitive member, a cleaning member contacting the electrophotographic photosensitive member for removing any developer remaining thereon, a first cleaning frame member having a photosensitive member supporting portion for supporting the photosensitive member, a first opening portion for directing the developer removed by the cleaning member to a removed developer containing portion, a second opening portion opened in a direction faced upwardly when the process cartridge is mounted on the main body, and a cleaning member supporting portion provided substantially over the full length of the cleaning member in a lengthwise direction of the first cleaning frame member for supporting the cleaning member, and a second cleaning frame member coupled to the first cleaning frame member to close the second opening portion and to cooperate with the first cleaning frame member to thereby constitute the developer containing portion.

25 Claims, 11 Drawing Sheets

PROCESS CARTRIDGE AND ELECTROPHOTOGRAPHIC IMAGE FORMING APPARATUS

BACKGROUND OF THE INVENTION

1. Field of the Invention

This invention relates to a process cartridge and an electrophotographic image forming apparatus.

The electrophotographic image forming apparatus is an apparatus for forming an image on a recording medium by use of the electrophotographic image forming system. The term "electrophotographic image forming apparatus" includes, for example, an electrophotographic copying apparatus, an electrophotographic printer (such as a laser beam printer or an LED printer), a facsimile apparatus and a word processor.

Also, the process cartridge has cleaning means and an electrophotographic photosensitive member integrally made into a cartridge which is removably mountable onto a main body of the electrophotographic image forming apparatus. Also, in addition to the cleaning means, at least charging means or developing means and the electrophotographic photosensitive member are integrally made into a cartridge which is removably mountable onto the main body.

2. Related Background Art

An electrophotographic image forming apparatus such as an electrophotographic copying apparatus or a laser beam printer has, for example, a photosensitive drum, and known processes such as charging, exposure and development are successively carried out for this photosensitive drum to thereby form a toner image thereon, and the image is transferred onto a recording medium such as transfer sheet. Then, the step of removing any toner remaining on the photosensitive drum by a cleaning device is carried out, and an image is formed.

In such an electrophotographic image forming apparatus, in recent years, the process cartridge system has been widely adopted to facilitate the compactness and maintenance of the apparatus. This process cartridge system is a system wherein a photosensitive drum and process means acting thereon, such as charging means, developing means and cleaning means, are integrally made into a cartridge which is removably mountable onto the main body by a user himself.

SUMMARY OF THE INVENTION

It is an object of the present invention to provide a process cartridge having a cartridge frame of high rigidity, and an electrophotographic image forming apparatus on which such a process cartridge can be removably mounted.

It is another object of the present invention to provide a process cartridge which enables process cartridges of different toner capacities, the cleaning frame member of a cleaning device and process means attached thereto to be used in common, and an electrophotographic image forming apparatus on which such process cartridge can be removably mounted.

An object of the present invention is to provide a process cartridge removably mounted on a main body of an electrophotographic image forming apparatus, the process cartridge comprising:

(a) an electrophotographic photosensitive member;

(b) a cleaning member contacting the electrophotographic photosensitive member for removing any developer remaining thereon;

(c) a first cleaning frame member having:

a photosensitive member supporting portion for supporting the photosensitive member, a first opening portion for directing the developer, removed by the cleaning member, to a removed developer containing portion;

a second opening portion opened in a direction faced upwardly when the process cartridge is mounted on the main body; and a cleaning member supporting portion provided substantially over the full length of the cleaning member in a lengthwise direction of the first cleaning frame member for supporting the cleaning member; and (d) a second cleaning frame member coupled to the first cleaning frame member to close the second opening portion and to cooperate with the first cleaning frame member to thereby constitute an developer containing portion.

Also, the object of the present invention is to provide a process cartridge removably mounted on an electrophotographic image forming apparatus body, the process cartridge comprising:

(a) an electrophotographic photosensitive drum;

(b) a developing member for supplying a developer to the electrophotographic photosensitive drum to develop a latent image formed thereon;

(c) a cleaning member contacting the electrophotographic photosensitive drum for removing any developer remaining thereon;

(d) a developing frame for supporting the developing member;

(e) a first cleaning frame member pivotably connected to the developing frame, the first cleaning frame member having:

photosensitive drum supporting portions provided on one end and the other end of the first cleaning frame member in the lengthwise direction thereof for supporting the electrophotographic photosensitive drum;

a first opening portion for directing the developer removed by the cleaning member to a removed developer containing portion;

a second opening portion opened in a direction faced upwardly when the process cartridge is mounted on the main body;

a bottom portion provided to be located at a lower position when the process cartridge is mounted on the main body; and a cleaning member supporting portion for supporting the cleaning member, the cleaning member supporting portion being provided to extend substantially over a full length of the cleaning member in a lengthwise direction of the first cleaning frame member and to extend substantially from above to below when the process cartridge is mounted on the main body; and (f) a second cleaning frame member coupled to the first cleaning frame member to close the second opening portion and to cooperate with the first cleaning frame member to thereby constitute the developer containing portion.

Other objects and features of the present invention will be come fully apparent from the following detailed description taken in conjunction with the accompanying drawings.

DETAILED DESCRIPTION OF THE PREFERRED EMBODIMENTS

Some embodiments of the present invention will hereinafter be described in detail with reference to the drawings. Herein a laser beam printer is shown as a form of the electrophotographic image forming apparatus. This laser beam printer, as will be described later, permits a process cartridge to be removably mounted thereon.

The process cartridge and the laser beam printer will first be described with reference to FIGS. 1 to 10.

Here, the general constructions of the laser beam printer and the process cartridge will first be described, and then the construction of a photosensitive drum in the process cartridge and the surroundings thereof will be described.

Figure 3:
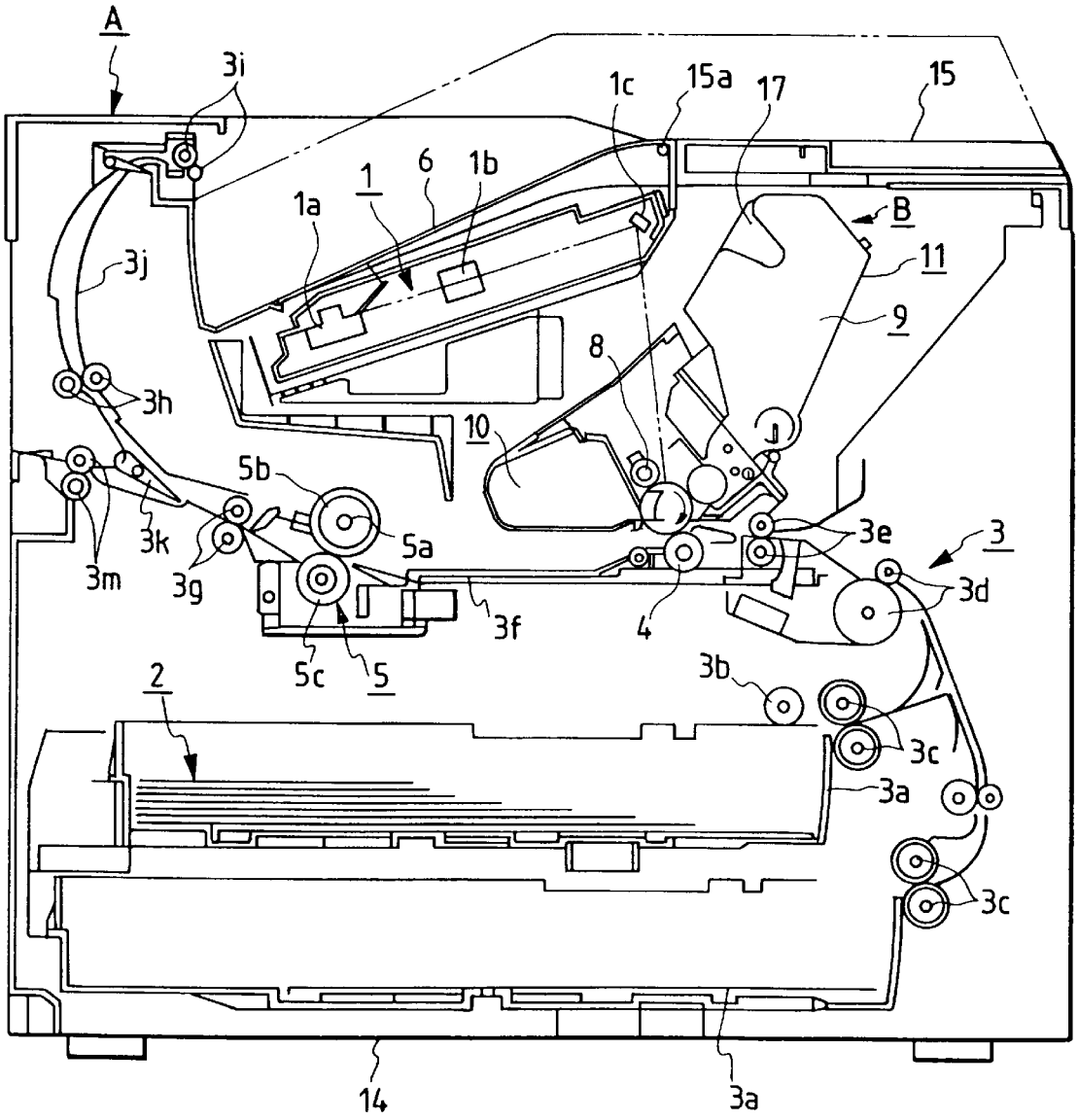
FIG. 3 is a longitudinal cross-sectional view of an image forming apparatus.

In this laser beam printer A, as shown in FIG. 3, light emitted from a laser source in conformity with image information is scanned by a rotating polygon mirror 1*a,* and this scanned light enters optical means 1 having a lens 1*b* and a reflecting mirror 1*c.* An optical image based on the image information is then applied from this optical means 1 to a photosensitive drum 7 as an electrophotographic photosensitive member, to form a toner image.

In synchronism with the formation of the toner image, a recording medium 2 such as a transfer sheet is reversely conveyed from a cassette 3*a* by conveying means 3 comprising a pickup roller 3*b,* a pair of conveying rollers 3*c* and 3*d* and a pair of register rollers 3*e.* Also, the toner image, formed on the photosensitive drum 7 in an image forming portion made into a process cartridge B, is transferred to the recording medium 2 by a voltage being applied to a transfer roller 4 serving as transfer means.

Further, after the transfer of the toner image, the recording medium 2 is guided by a guide member 3*f* and conveyed to fixing means 5 comprising a fixing roller 5*b* containing a heater 5*a* therein and a driving roller 5*c* for pressing the recording medium 2 against the fixing roller 5*b* and conveying it to fix the transferred toner image on the recording medium 2. This recording medium 2 is then conveyed by pairs of discharge rollers 3*g,* 3*h,* and 3*i* and discharged onto a discharge portion 6 through a reverse conveyance route 3*j.* As regards the discharging of the recording medium, it is also possible to operate a pivotally movable flapper 3*k* and discharge in a straight direction the recording medium by a pair of discharge rollers 3*m* without the intermediary of the reverse conveyance route 3*j.*

Figure 1:
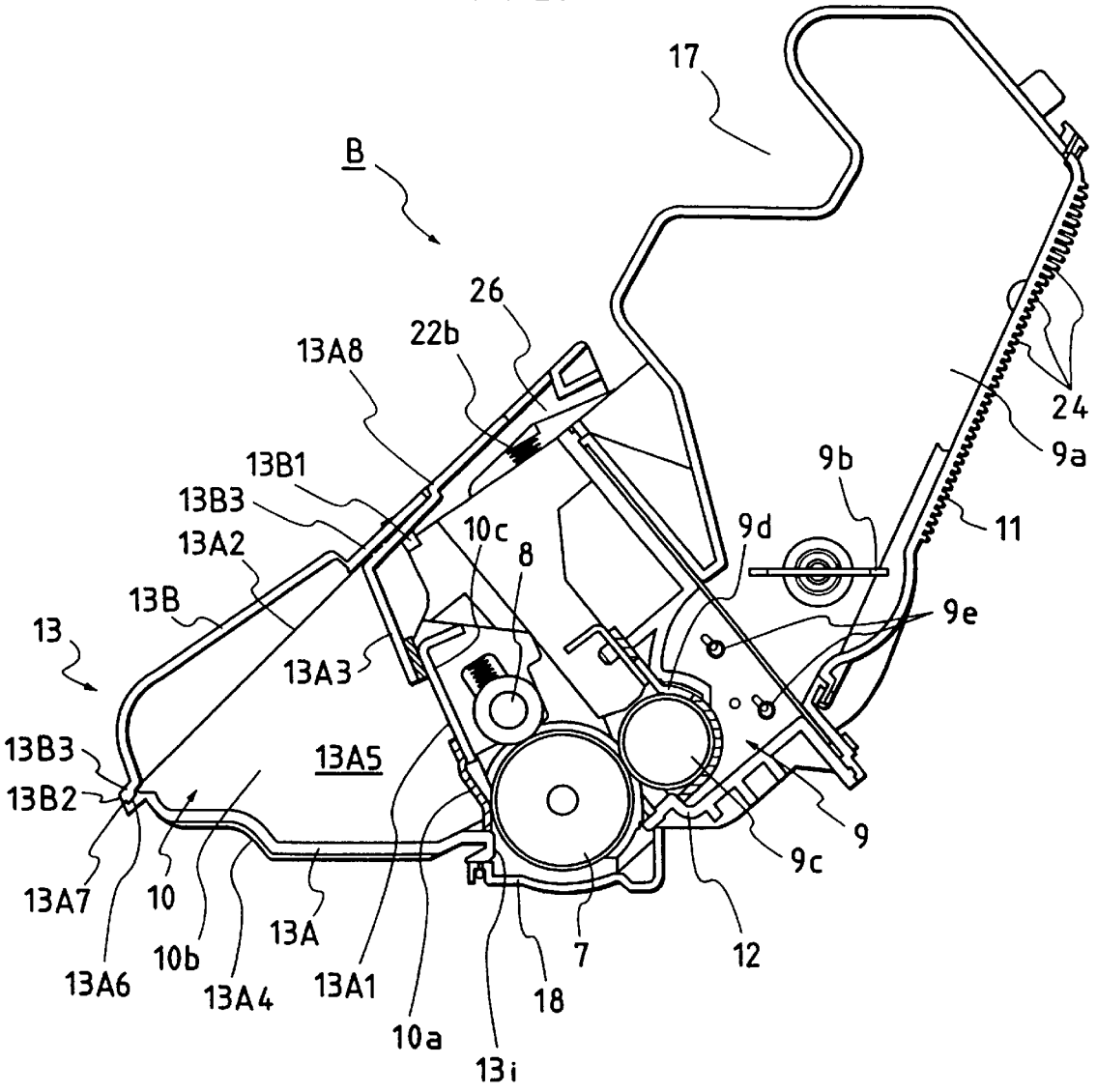
FIG. 1 is a longitudinal cross-sectional view of a process cartridge according to Embodiment 1 of the present invention.

On the other hand, the process cartridge B constituting the image forming portion has the photosensitive drum 7 having a photosensitive layer, which is rotated by a drive force from the body of the laser beam printer A, as shown in FIG. 1. The surface of this photosensitive drum 7 is uniformly charged by a voltage being applied to a charging roller (charging means) 8, and the optical image from the optical means 1 is exposed on the photosensitive drum 7 through an exposure opening 26 to thereby form a latent image, which is then developed by developing device (developing means) 9.

The developing means 9 feeds out a toner in a toner containing portion 9*a* by a toner feeding member 9*b* and rotates a developing roller 9*c* containing a fixed magnet therein, and also forms a toner layer having frictional charging charges imparted thereto on the developing roller 9*c* by an agitating member 9*e* and a developing blade 9*d.* Further, the toner is transferred to the photosensitive drum 8 in conformity with the latent image thereon to thereby form and visualize the toner image. The toner image is transferred to the recording medium by a voltage opposite in polarity to the toner image being applied to a transfer roller 4. Thereafter, any toner remaining on the photosensitive drum 7 is scraped off by a cleaning blade 10*a,* and the toner remaining on the photosensitive drum 7 is removed by cleaning means 10 for collecting the toner into a toner reservoir (removed developer containing portion) 10*b* by a scrape sheet 13*i.*

A cartridge frame member is comprised of a toner container 11 and a developing frame member 12 coupled together, and a cleaning frame member 13 coupled thereto. The parts such as the photosensitive drum 7, etc. are contained in the cartridge frame member and is made into a cartridge, and this process cartridge B is removably mounted onto cartridge mounting means provided in the main body 14 of the laser beam printer A.

Construction of a Housing

The process cartridge B constitutes a housing with the toner container 11, the developing frame member 12 and the cleaning frame member 13 coupled together as previously described. That is, as shown in FIG. 1, the toner containing portion 9*a* is formed in the toner container 11, and the toner feeding member 9*b* is mounted therein. Also, the developing roller 9*c* and the developing blade 9*d* are mounted on the developing frame member 12, and the agitating member 9*e* for circulating the toner in the developing chamber is rotatably mounted near the developing roller 9*c.* The toner container 11 and the developing frame member 12 are welded together to thereby constitute an integral developing unit.

Also, the photosensitive drum 7, the charging roller 8, and the cleaning blade 10*a* are mounted on the cleaning frame member 13 and further, a drum shutter 18 for covering and protecting the photosensitive drum 7 when the process cartridge B is removed from the main body 14, is mounted to thereby constitute a cleaning unit.

Figure 7:
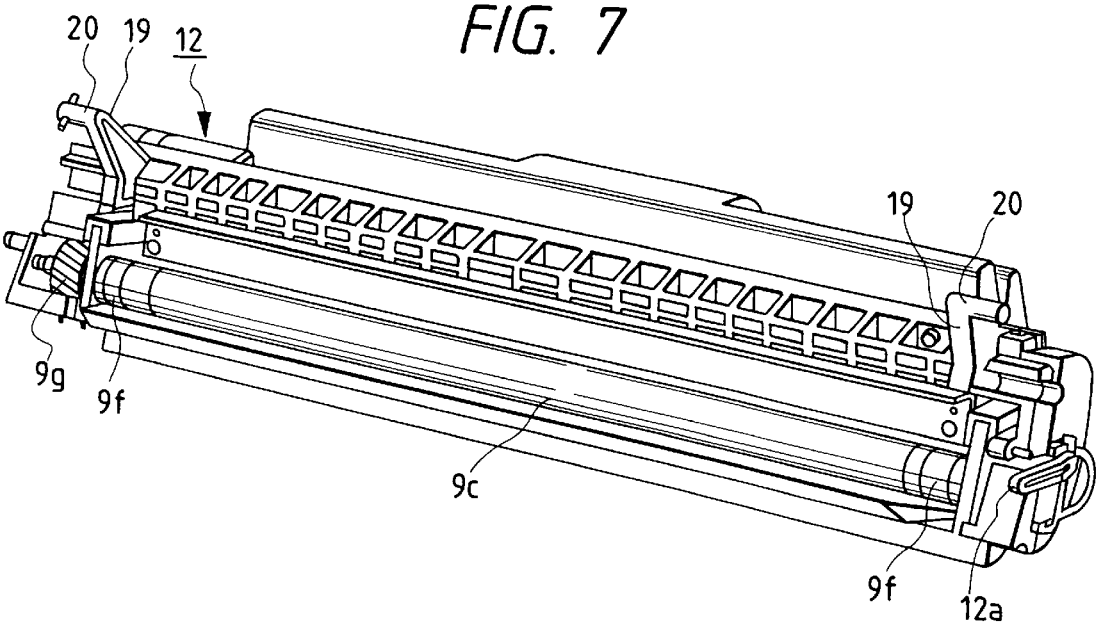
FIG. 7 is a perspective view of a developing unit.
Figure 8:
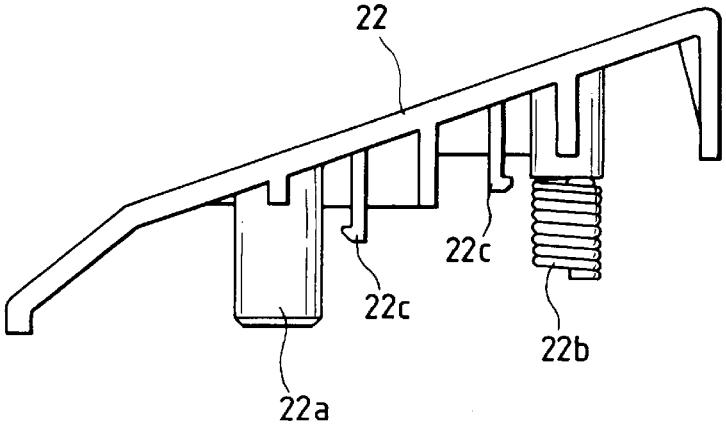
FIG. 8 is a longitudinal cross-sectional view of a coupling member.
Figure 9:
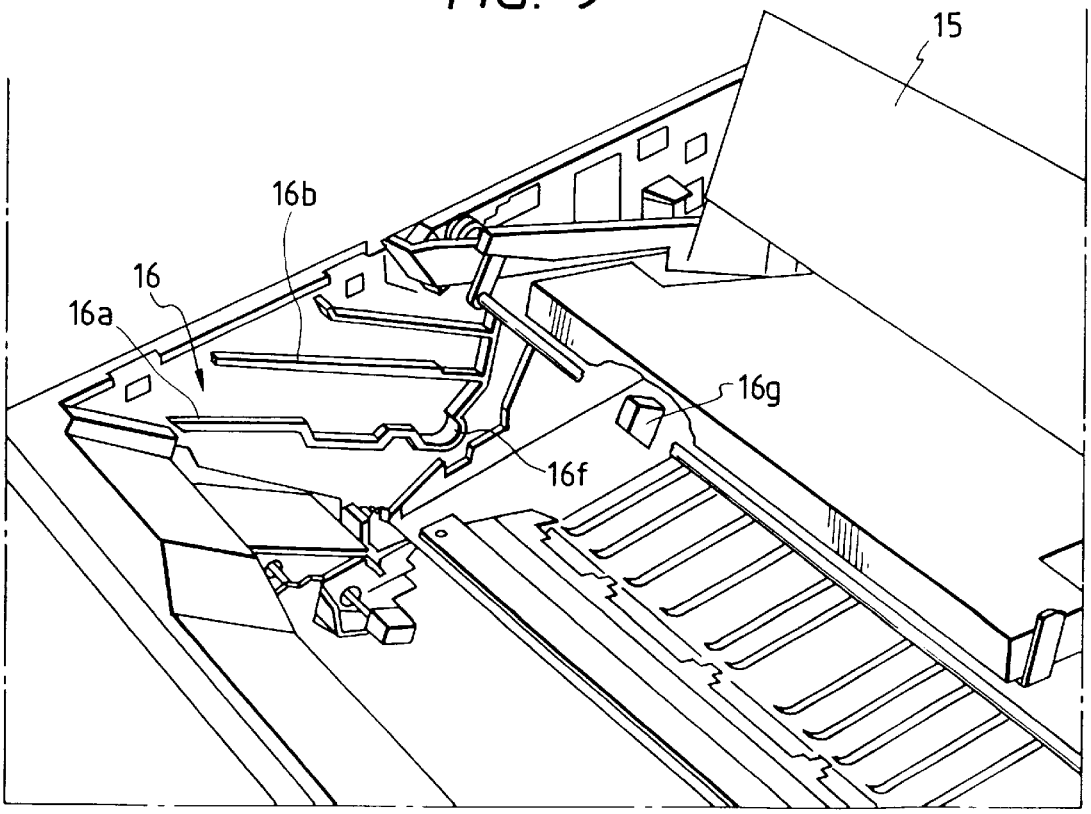
FIG. 9 is a perspective view showing the process cartridge mounting portion of the image forming apparatus.

The developing unit and the cleaning unit are coupled together by a coupling member to thereby constitute the process cartridge B. That is, as shown in FIG. 7, pivot shafts 20 are provided on the tip ends of arm portions 19 formed on the lengthwise opposite sides of the developing frame member 12, and on the other hand, recesses 21 for positioning and restraining the pivot shafts 20 are formed at two locations on the lengthwise opposite sides of the cleaning frame member 13 (see FIG. 6). The pivot shafts 20 are inserted into these recesses 21, and a coupling member 22, integrally having a convex portion 22*a*, a pressing spring 22*b* which is a compression spring, and restraining pawls 22*c* shown in FIG. 9, is snap-fitted to the cleaning frame member 13. The developing unit and the cleaning unit are coupled together for pivotal movement about the pivot shafts 20, and the developing roller 9*c* is urged against the photosensitive drum 7 by the gravity of the developing unit.

At this time, the developing frame member 12 is downwardly biased by the pressing spring 22*b* mounted on the coupling member 22 to thereby reliably urge the developing roller 9*c* against the photosensitive drum 7. Also, spacer rings 9*f* (see FIG. 7) slightly larger in radius than the developing roller 9*c* are mounted on the lengthwise opposite sides of the developing roller 9*c*. Therefore, these spacer rings 9*f* are urged against the photosensitive drum 7 so that the photosensitive drum 7 and the developing roller 9*c* are opposed to each other with a predetermined spacing (about 300 $\mu$m) therebetween.

The spacing between the photosensitive drum 7 and the developing roller 9*c* is closely related to the light and shade of an image and high accuracy is required of it, and therefore in the present embodiment, the spacing is designed to be within about 300 $\mu$m±30 $\mu$m. That is, the spacing is controlled by only the spacer rings 9*f* mounted to the left and right of the developing roller 9*c*, and therefore in the present embodiment, the tolerance of the circularity of the photosenstive drum 7 is designed to be within about 15 $\mu$m such that any density difference does not come out. Therefore, the difference between the left and right gaps is within about 15 $\mu$m.

Construction of the Cleaning Frame Member

The cleaning frame member 13 is comprised of two cleaning frame members 13A and 13B. The first cleaning frame member 13A has the photosensitive drum 7, the cleaning blade 10*a* and the charging roller 8, integrally incorporated therein. The first cleaning frame member 13A, as already described, has the recesses 21 for coupling it to the developing unit formed in the lengthwise opposite end portions thereof, and the cleaning blade 10*a* and the charging roller 8 are mounted between the opposite surfaces of the lengthwise inner side plates 13A5 constituting the recesses 21, and the photosensitive drum 7 is mounted between the lengthwise outer walls constituting the recesses 21 (see FIG. 6).

Also, toner reservoirs (removed developer containing portions) 10*b* are provided in the cleaning frame members 13A and 13B, and a first opening portion 13A1 of the toner reservoir 10*b* of the first cleaning member 13A which faces the photosensitive drum 7 is covered with a support metal plate 10*c* having the cleaning member (cleaning blade) 10*a* welded to the end thereof. The first opening portion 13A1 is small so as to be covered with the support metal plate 10*c* of the short narrow cleaning blade.

Also, the space in which the toner reservoir 10*b* and the photosensitive drum 7 are contained and the space in which the charging roller 8 is contained are partitioned by a partition wall 13A3, the cleaning blade 10*a* and the support metal plate 10*c*. Accordingly, the opening portion 13A1 is opened only between the photosensitive drum 7 and the tip end of the cleaning blade 10*a* to the scrape sheet 13*i*. The length of the first opening portion 13A1 is substantially equal to the length of the cleaning blade 10*a* or the charging roller 8.

Accordingly, the toner reservoir 10*b* is defined, except its upper portion, by the first cleaning frame member 13A, the cleaning blade (cleaning means) 10*a* and the support metal plate 10*c*. The first cleaning frame member 13A constitutes a portion of the surroundings of the toner reservoir 10*b* by a bottom plate 13A4, an inner side plate 13A5 and the partition wall 13A3 and also supports the already described charging roller 8 and the photosensitive drum 7. Further, the developing unit and the cleaning unit are coupled together by the coupling member 22, and the photosensitive drum 7 and the developing roller 9*c* may be brought into pressure contact with each other by the pressing spring 22*b*, which is a compression coil spring.

Figure 11:
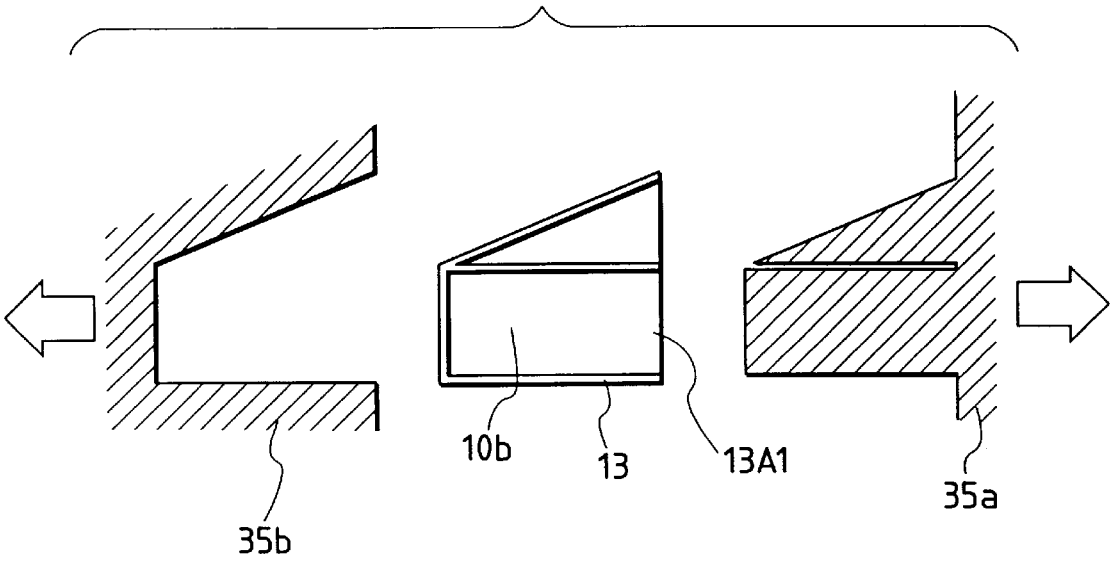
FIG. 11 is a schematic illustration of the mold structure of a cleaning frame member according to the prior art.
Figure 12:
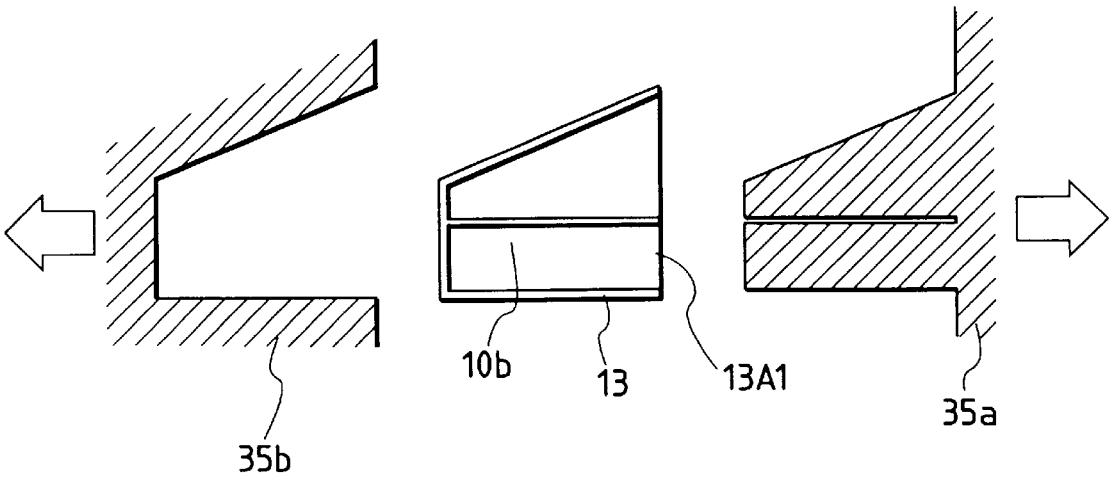
FIG. 12 is a schematic illustration of the opening portion of the cleaning frame member reduced by the mold structure according to the prior art.
Figure 13:
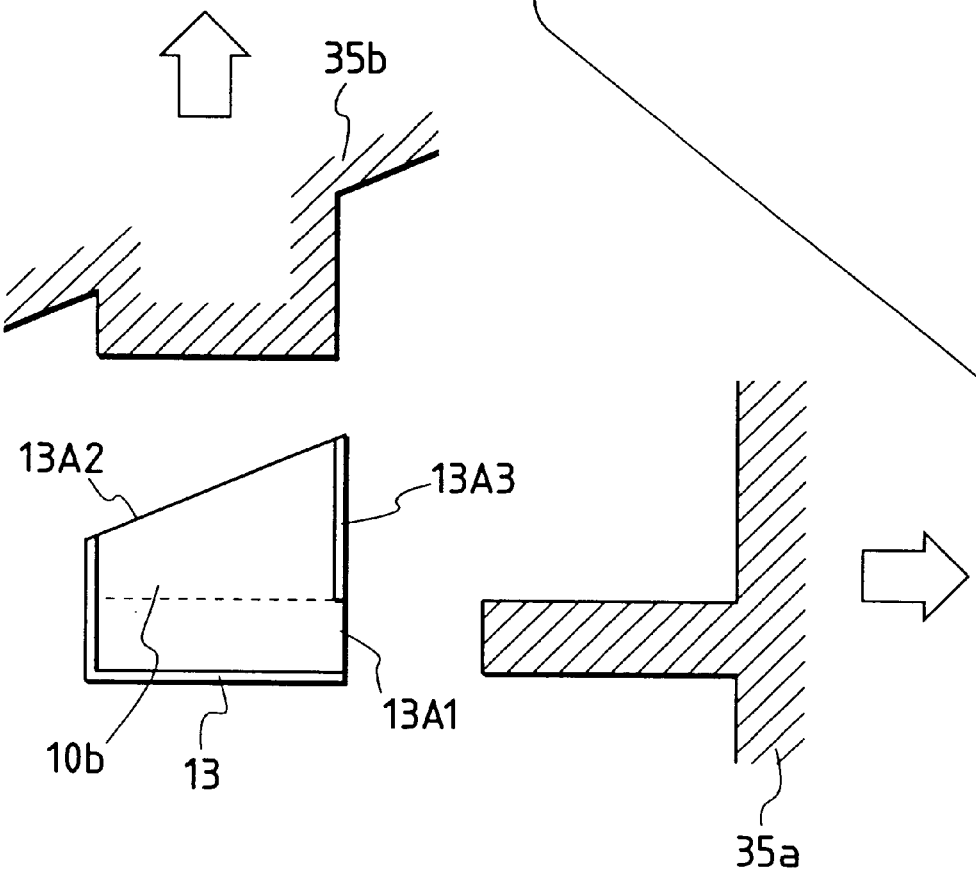
FIG. 13 is a schematic illustration of the mold structure of a cleaning frame member according to Embodiments 1 and 2.

The first cleaning frame member 13A is integrally molded of resin, and therefore the construction of the conventional mold used for molding is generally the structure shown in FIG. 11. If the opening portion 13A1 is made small, the toner reservoir 10*b* will become small in terms of the construction of molds 35*a* and 35*b* for molding, as shown in FIG. 12. So, to secure a large toner reservoir 10*b* in terms of the structure of the mold for molding as shown in FIG. 13, a second opening portion 13A2 becomes necessary. For this purpose, the second opening portion 13A2 is covered with the second cleaning frame member 13B. The first cleaning frame member 13A and the second cleaning frame member 13B are coupled together by a vibration welding, ultrasonic welding, an adhesive agent, or screwing so that the toner may not leak.

More particularly, a flange 13A6 is provided on the edge of the second opening portion 13A2 of the first cleaning frame member 13A with a portion of an upper plate 13A8 made common, and the upper surface of this flange 13A6 has a surrounding groove 13A7. On the other hand, the second cleaning frame member 13B coupled to the first cleaning frame member 13A is also provided with a flange 13B3 having on the lower surface thereof a ridge 13B2 fitted in the groove 13A7 formed in the flange 13A6 of the first cleaning frame member 13A. The groove 13A7 and the ridge 13B2 are welded together or adhesively secured to each other by the already described joining method.

The first cleaning frame member 13A and the second cleaning frame member 13B are positioned by a dowel 13B1 provided on the second cleaning frame member 13B being fitted in an aperture (not shown), in the portion of the flange 13B3 bent from the upper end of the partition wall 13A3 of the first cleaning frame member 13A.

That is, the first cleaning frame member 13A has a photosensitive member supporting portion (e.g. a lengthwise outer wall constituting the recess 21) for supporting the electrophotographic photosensitive member, a first opening portion (e.g. the first opening portion 13A1) for directing the developer removed by the cleaning member to the removed developer containing portion, a second opening portion (e.g. the second opening portion 13A2) opening in an upward direction when the process cartridge is mounted on the main body, and a cleaning member supporting portion (e.g. the partition plate 13A3) for supporting the cleaning member, the cleaning member supporting portion being provided substantially over the full length of the cleaning member in the lengthwise direction of the first cleaning frame member.

Also, the second cleaning frame member 13B is coupled to the first cleaning frame member 13A so as to close the second opening portion and to cooperate with the first cleaning frame member to thereby constitute the developer containing portion.

Also, the first cleaning frame member 13A has a bottom portion (e.g. a bottom plate 13A4) provided at a location which becomes lower when the process cartridge is mounted on the main body, and the photosensitive member supporting portion (e.g. the lengthwise outer wall constituting the recess 21) is provided on one end and the other end in the lengthwise direction of the first cleaning frame member, and the cleaning member supporting portion (e.g. the partition plate 13A3) is provided substantially from above to below with the process cartridge mounted on the main body.

As described above, the vertical partition wall 13A3 is provided in the first cleaning frame member 13A and moreover, the first cleaning frame member 13A and the second cleaning frame member 13B are coupled together as by ultrasonic welding in such a manner as to close the second opening portion 13A2 by the first cleaning frame member 13A. Accordingly, a box-type cleaning frame member 13 is constructed as a whole, and the rigidity thereof becomes high and vibration or the like, which adversely affects the image, is suppressed and the quality of image can be improved.

Particularly, the presence of the vertical partition plate 13A3 makes the rigidity of the cleaning frame member high. Moreover, the flanges 13A6 and 13B3 are provided around the second opening portion 13A2 and these flanges 13A6 and 13B3 are coupled together as by ultrasonic welding to improve the rigidity of the cleaning frame member 13.

Figure 2:
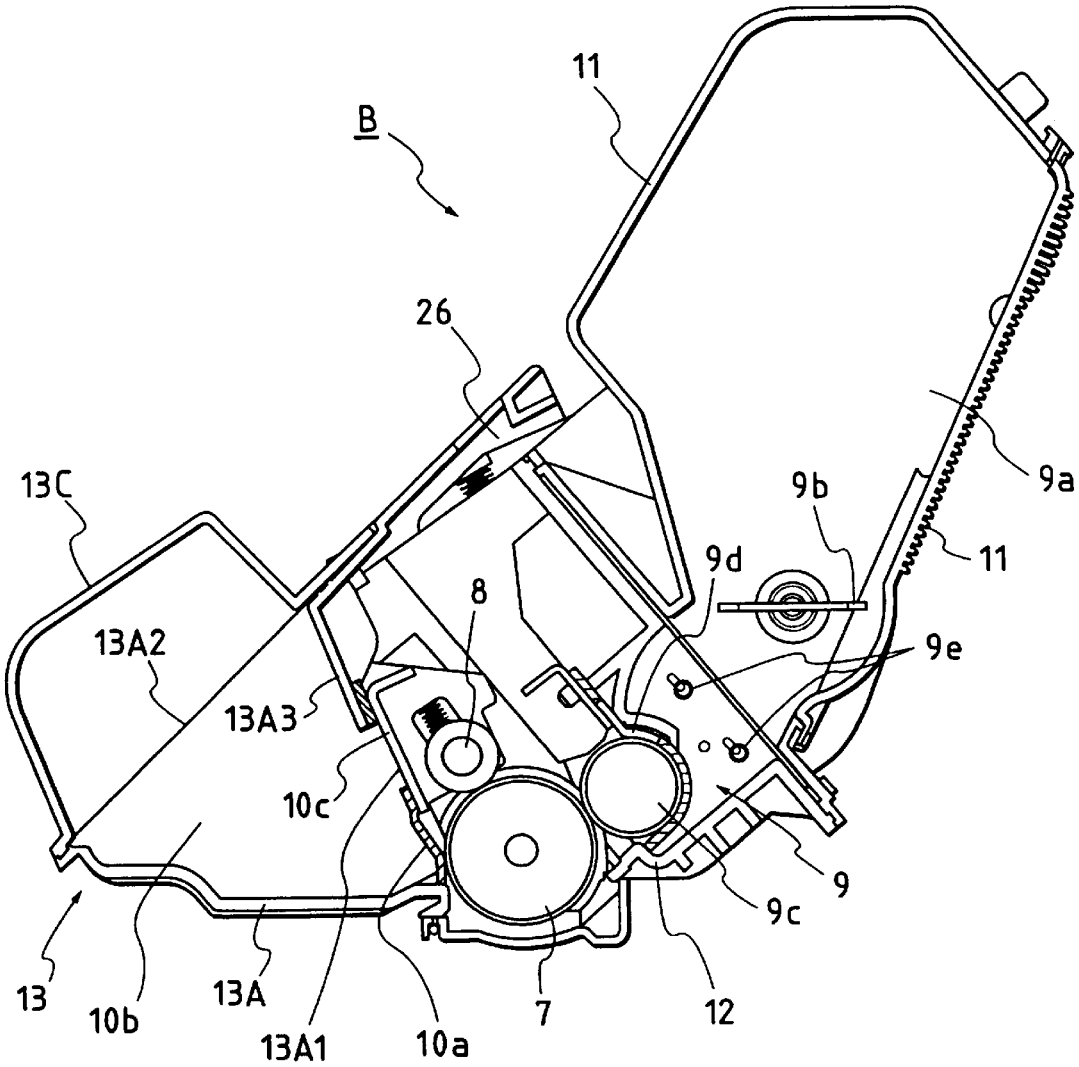
FIG. 2 is a longitudinal cross-sectional view of a process cartridge according to Embodiment 2 of the present invention.
Figure 14:
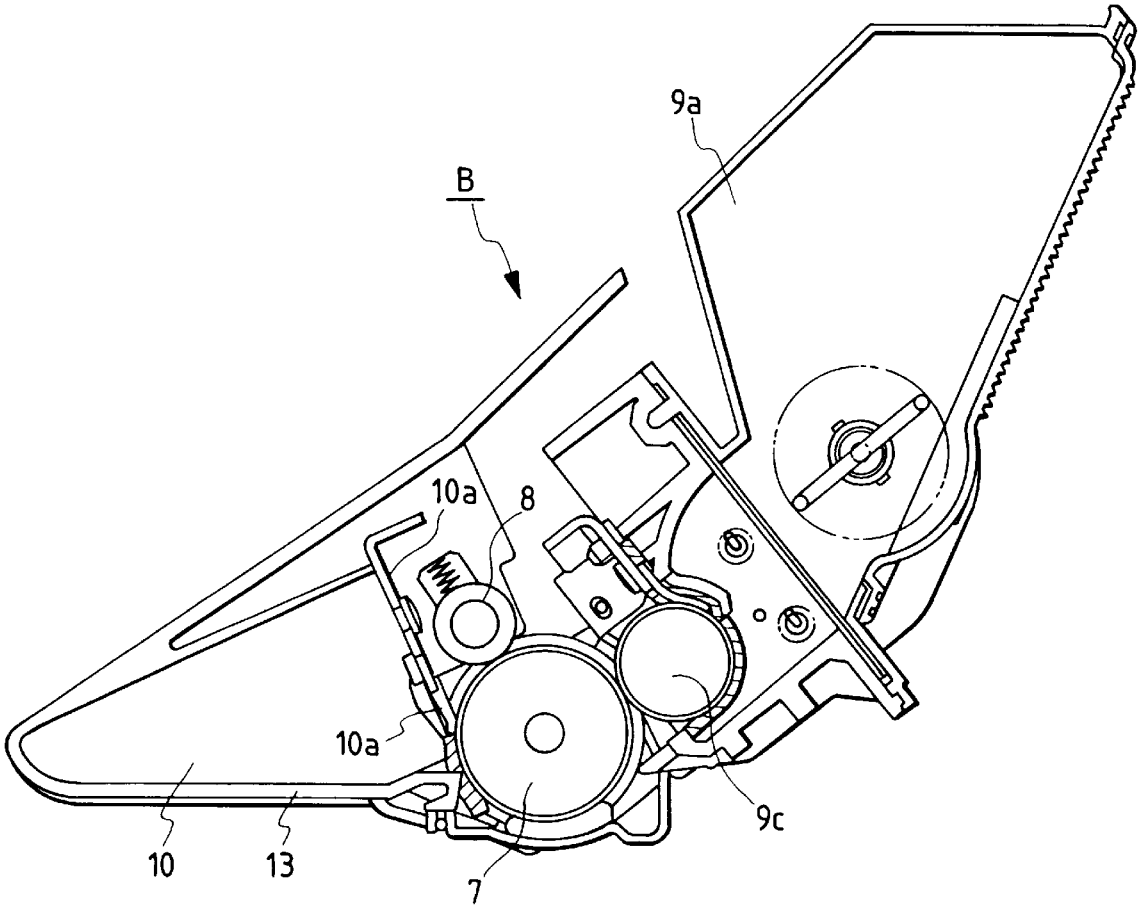
FIG. 14 is a longitudinal cross-sectional view of a process cartridge having a cleaning blade according to Embodiment 1.

Also, the process cartridge 13 shown in FIGS. 1 and 2 has the toner reservoir 10*b* of long life and large capacity, but as shown in FIG. 14, in a compact process cartridge, a cleaning blade 10*a* of the same size as the recess cartridge can also be used so as to copy with a compact and thin body. Accordingly, the part (e.g. the cleaning blade) can be made common, to thereby reduce the cost.

Also, if as shown in FIG. 2, a cleaning frame member 13C larger in volume than the second cleaning frame member 13B is used instead of the second cleaning member 13B, the cleaning frame member 13A and the process means attached to the cleaning frame member 13A can be intactly used. That is, the volume of the toner reservoir 10*b* can also be changed simply by changing the size of the second cleaning frame member.

That is, in the process cartridges of medium toner volume and large toner volume as shown in FIGS. 1 and 2, it is also possible to use the same ones as the first cleaning frame member 13A, the photosensitive drum 7, the charging roller 8, the cleaning blade 10*a,* the developing frame member 12, the developing roller 9*c,* the developing blade 9*d* and the agitating member 9*e*. Further, the cleaning blade 10*a* can also be used in the process cartridge B removably mounted in a compact and thin main body (not shown), as shown in FIG. 14.

Mounting Means for the Process Cartridge

Figure 10:
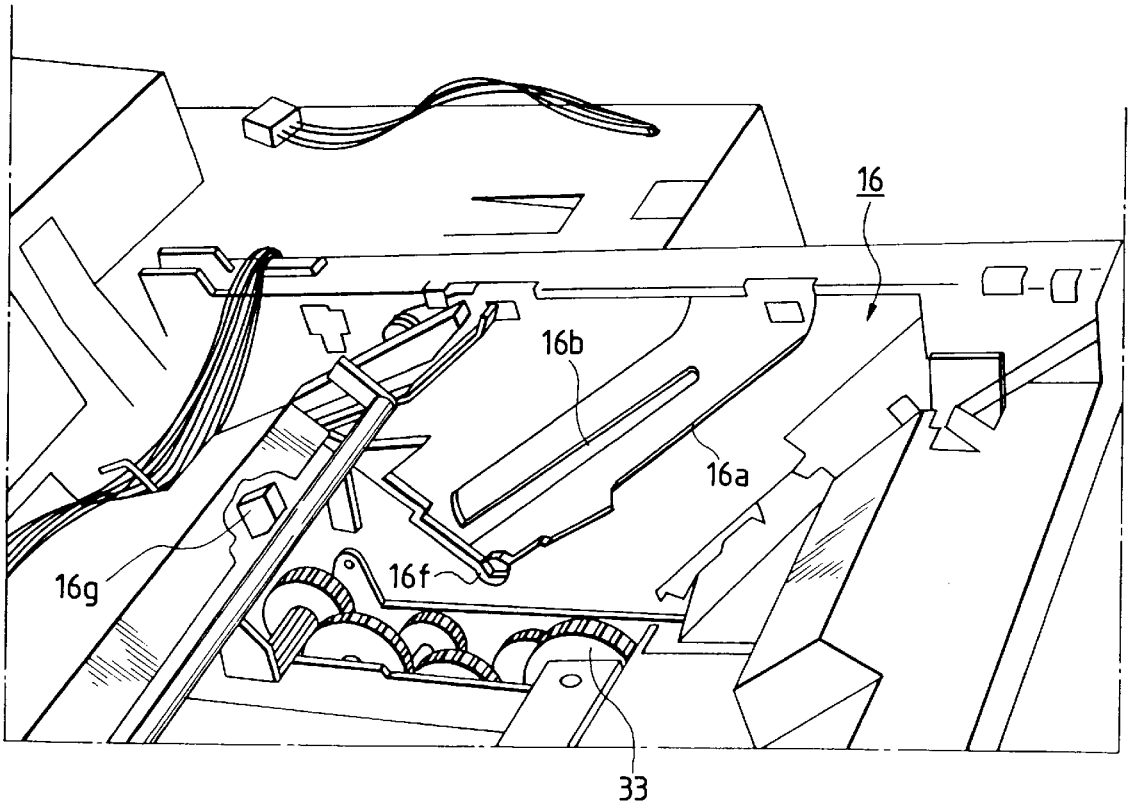
FIG. 10 is a perspective view showing the process cartridge mounting portion of the image forming apparatus.

When in FIG. 3, an openable-closable member 15 is opened while being rotated counter-clockwise about a support shaft 15*a,* it will be seen that a cartridge mounting space is provided as shown in FIGS. 9 and 10. Cartridge mounting guide members (cartridge mounting means) 16 are attached to the left and right inner side surfaces of the main body 14. These left and right guide members 16 are provided with two guide portions 16*a* and 16*b* opposed to each other for guiding dowels 13*a,* long guides 12*a* and short guides 13*b* on the opposite sides of the process cartridge B shown in FIG. 5. The process cartridge B is inserted along these guide portions 16*a* and 16*b,* and the dowels 13*a* are fitted to positioning portions 16*f* and the rotation receiving portion 13*c* (see FIG. 4) of the process cartridge B is supported by a rotation stopping portion 16*g* below the optical means 1 of the main body 14, and then the openable-closable member 15 is closed. Thereby, the positioning and mounting of the process cartridge B onto the laser beam printer A is completed.

By this positioning and mounting, a drum gear (level gear) 7*b* mounted on one end portion of the photosensitive drum 7 as by being forced in or caulked is brought into meshing engagement with a driving gear 33 (see FIG. 10) on the main body, and a transmission gear (spur gear) 7*c* (see FIG. 6) mounted on the other end portion of the photosensitive drum 7 is brought into meshing engagement with a gear (not shown) fixed to the core shaft of the transfer roller 4. Also, the sleeve gear (level gear) 9*g* (see FIG. 7) of the developing roller 9*c* is in meshing engagement with the drum gear 7*b* of the photosensitive drum 7.

Accordingly, the rotative driving force of the driving gear 33 on the main body 14 is transmitted to the drum gear 7*b,* to rotate the photosensitive drum 7. Also, the developing roller 9*c* is rotated with the drive force transmitted to the sleeve gear 9*g* through the drum gear 7*b*. Further, the drive force is transmitted to the gear of the transfer roller 4 through the transmission gear 7*c* of the photosensitive drum 7 to rotate the transfer roller 4.

Figure 4:
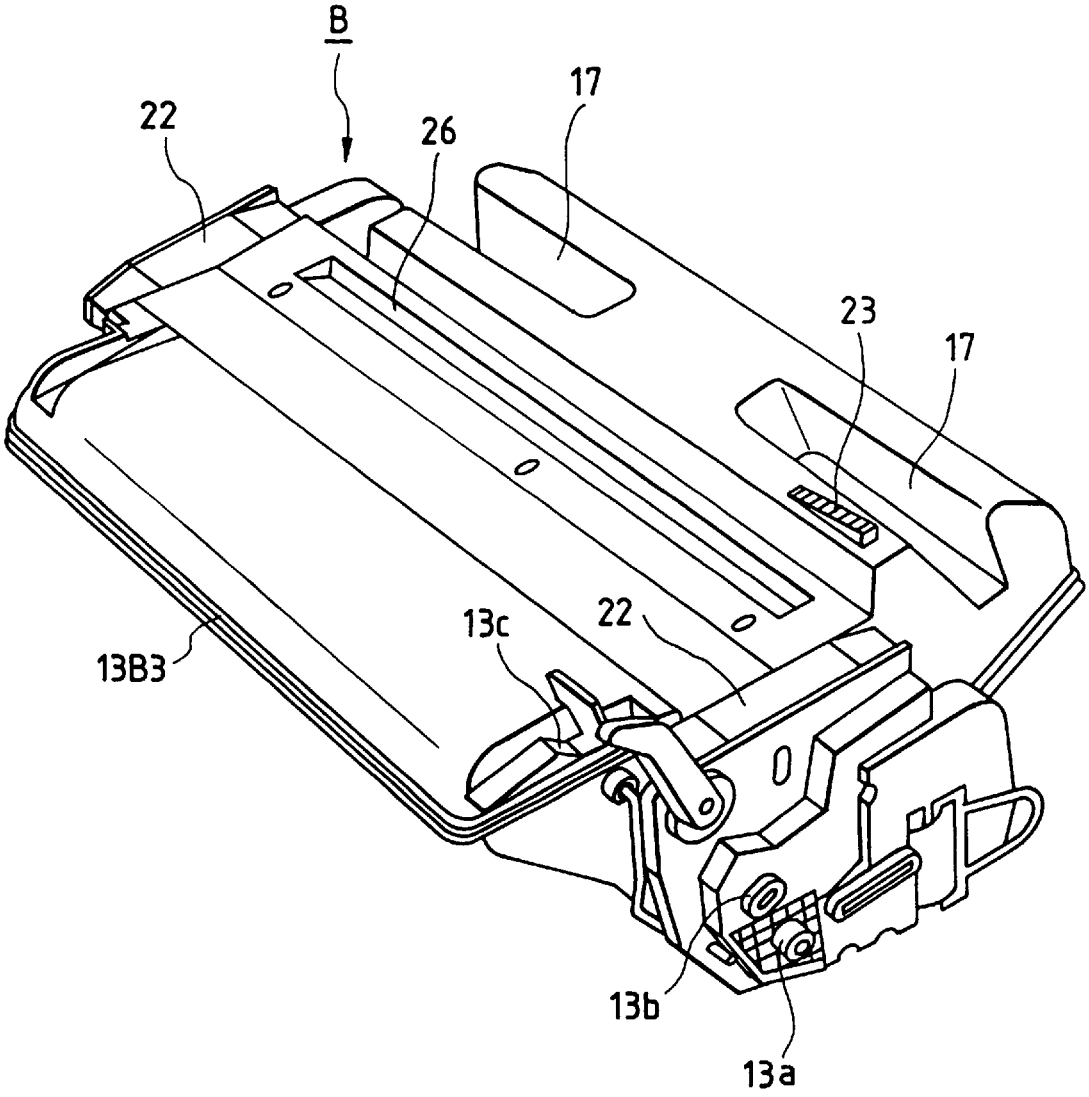
FIG. 4 is a perspective view of the process cartridge according to Embodiment 2 seen from above.
Figure 5:
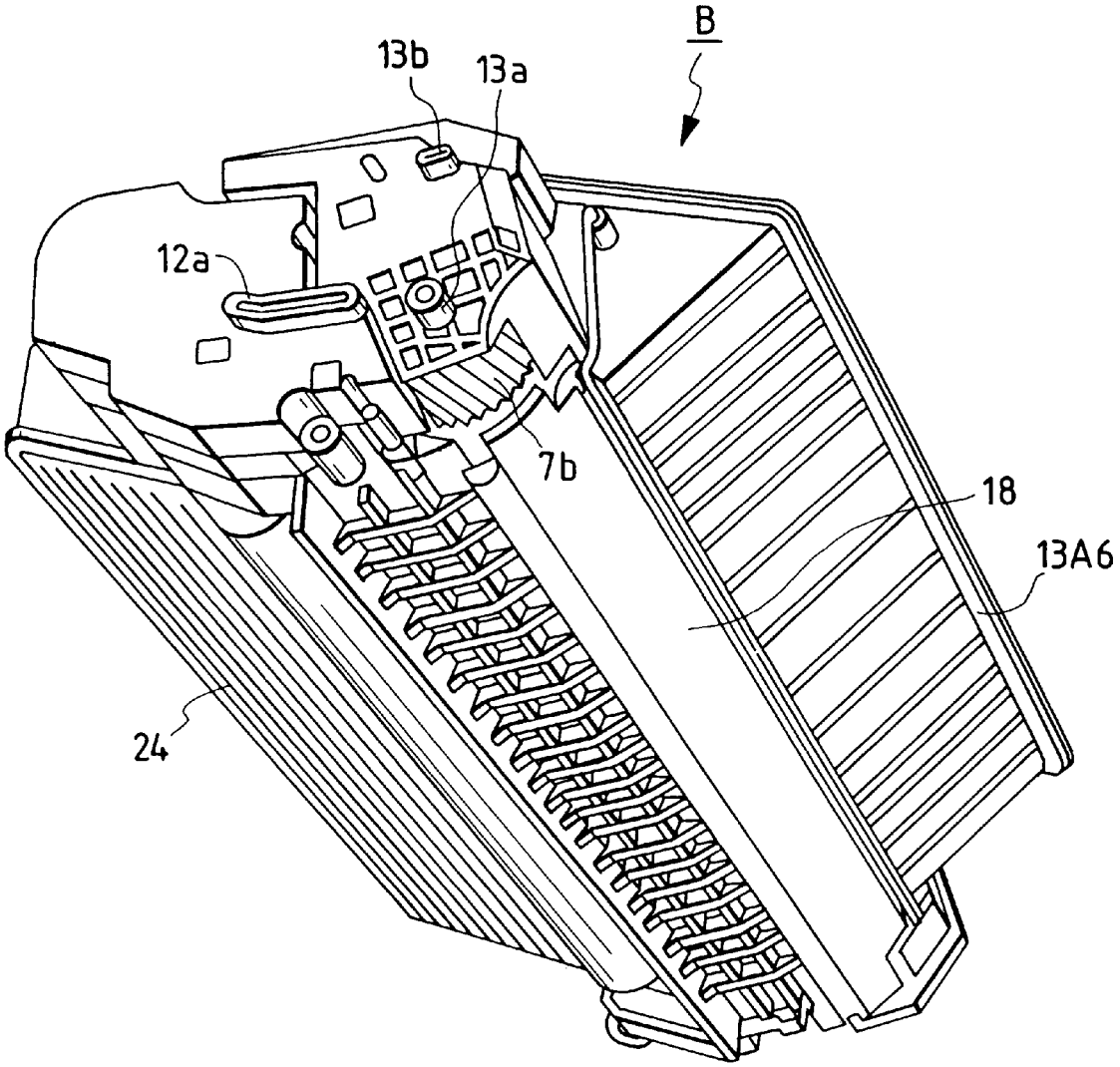
FIG. 5 is a perspective view of the process cartridge according to Embodiment 2 seen from below.
Figure 6:
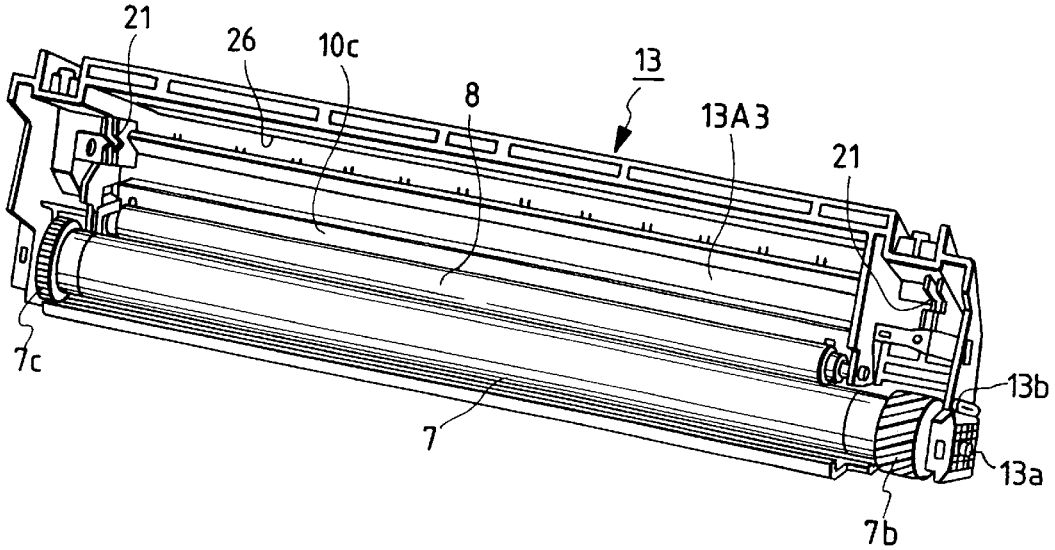
FIG. 6 is a perspective view of a cleaning unit.

A grip portion 17 and ribs 23, 24 are provided as shown in FIGS. 1, 4 and 5 so that the user may easily hold the process cartridge B when the process cartridge B is to be mounted on or dismounted from the main body 14. Further, the process cartridge B is provided with a drum shutter 18 (see FIG. 5) opened or closed in response to the mounting or dismounting of the process cartridge B onto the image forming apparatus A, and when the process cartridge B is removed from the image forming apparatus A, the drum shutter 18 is automatically closed to rotate, whereby the photosensitive drum 7 is protected.

As described above, according to the present embodiment, the entire cleaning frame member comprising the first and second cleaning frame members coupled together is fox-shaped, so that the rigidity thereof is improved and vibration or the like, which adversely affects the image, is suppressed and the quality of image can be improved. Particularly, by the vertical partition wall being provided between the first and second opening portions of the first cleaning frame member, the rigidity of the entire cleaning frame member is further enhanced.

Also, the toner containing portion can be efficiently provided in the cleaning frame member, so that a process cartridge, which requires a toner containing portion of large capacity, can be coped with.

Also, process cartridges of different toner capacities, the cleaning frame member of the cleaning device and process means attached thereto can be used in common.

What is claimed is:

1. A process cartridge removably mounted on a main body of an electrophotographic image forming apparatus, said process cartridge comprising:

(a) an electrophotographic photosensitive member;

(b) a cleaning member contacting said electrophotographic photosensitive member for removing any developer remaining thereon;

(c) a first cleaning frame member having:

an exposure opening through which information light from the main body passes to irradiate said electrophotographic photosensitive member when said process cartridge is mounted on the main body of the electrophotographic image forming apparatus;

a photosensitive member supporting portion for supporting said electrophotographic photosensitive member;

a first opening portion for directing the developer removed by said cleaning member to a removed developer containing portion;

a second opening portion opened in a direction faced upwardly when said process cartridge is mounted on the main body; and a cleaning member supporting portion provided substantially over the full length of said cleaning member in a lengthwise direction of said first cleaning frame member for supporting said cleaning member; and (d) a second cleaning frame member coupled to said first cleaning frame member to close said second opening portion and to cooperate with said first cleaning frame member to thereby constitute said removed developer containing portion.

2. A process cartridge according to claim 1, wherein said first cleaning frame member and said second cleaning frame member are coupled together by an ultrasonic welding.

3. A process cartridge according to claim 2, wherein said first cleaning frame member further has a charging member for charging said electrophotographic photosensitive member.

4. A process cartridge according to claim 3, wherein said cleaning member has a cleaning blade and a blade supporting member supported by said cleaning member supporting portion.

5. A process cartridge according to claim 4, wherein said first cleaning frame member has a bottom portion which becomes lower when said process cartridge is mounted on the main body, wherein said photosensitive member supporting portion is provided on one end and another end of said first cleaning frame member, in a lengthwise direction thereof, and wherein said cleaning member supporting portion is provided to extend substantially from above to below with said process cartridge mounted on the main body.

6. A process cartridge according to claim 1, wherein at least charging means, for charging said electrophotographic photosensitive member or developing means for supplying the developer to said electrophotographic photosensitive member, said cleaning member and said electrophotographic photosensitive member are integrally made into a cartridge removably mountable onto the main body.

7. A process cartridge according to claim 2, wherein at least charging means, for charging said electrophotographic photosensitive member or developing means for supplying the developer to said electrophotographic photosensitive member, said cleaning member and said electrophotographic photosensitive member are integrally made into a cartridge removably mountable onto the main body.

8. A process cartridge removably mounted on a main body of an electrophotographic image forming apparatus, said process cartridge comprising:

(a) an electrophotographic photosensitive drum;

(b) a developing member for supplying a developer to said electrophotographic photosensitive drum to develop a latent image formed thereon;

(c) a cleaning member contacting said electrophotographic photosensitive drum for removing any developer remaining thereon;

(d) a developing frame, for supporting said developing member;

(e) a first cleaning frame member pivotably connected to said developing frame, said first cleaning frame member having:

an exposure opening through which information light from the main body passes to irradiate said electrophotographic photosensitive drum when said process cartridge is mounted on the main body of the electrophotogaphic image forming apparatus;

a photosensitive drum supporting portion provided on one end and the other end of said first cleaning frame member in a lengthwise direction thereof for supporting said electrophotographic photosensitive drum;

a first opening portion for directing the developer removed by said cleaning member to a removed developer containing portion;

a second opening portion opened in a direction faced upwardly when said process cartridge is mounted on the main body;

a bottom portion provided to be located at a lower position when said process cartridge is mounted on the main body; and a cleaning member supporting portion for supporting said cleaning member, said cleaning member supporting portion being provided to extend substantially over the full length of said cleaning member in a lengthwise direction of said first cleaning frame member and toy extend substantially from above to below when said process cartridge is mounted on said main body; and (f) a second cleaning frame member coupled to said first cleaning frame member to close said second opening portion and to cooperate with said first cleaning frame member to thereby constitute said removed developer containing portion.

9. A process cartridge according to claim 8, wherein said first cleaning frame member and said second cleaning frame member are coupled together by an ultrasonic welding.

10. A process cartridge according to claim 9, wherein said first cleaning frame member further has a charging member for charging said electrophotographic photosensitive drum.

11. A process cartridge according to claim 10, wherein said cleaning member has a cleaning blade and a blade supporting member supported by said cleaning member supporting portion.

12. An electrophotographic image forming apparatus for forming an image on a recording medium, said electrophotographic image forming apparatus comprising:

(a) mount means for removably mounting a process cartridge onto a main body of said electrophotographic image forming apparatus, said process cartridge including:

(i) an electrophotographic photosensitive member;

(ii) a cleaning member contacting said electrophotographic photosensitive member for removing any developer remaining thereon;

(iii) a first cleaning frame member having:

an exposure opening through which information light from said main body passes to irradiate said electrophotoraphic photosensitive member when said process cartridge is mounted on said main body of said electrophotographic image forming apparatus;

a photosensitive member supporting portion for supporting said electrophotographic photosensitive member;

a first opening portion for directing the developer removed by said cleaning member to a removed developer containing portion;

a second opening portion opened in a direction faced upwardly when said process cartridge is mounted on said main body of said electrophotographic image forming apparatus; and a cleaning member supporting portion provided substantially over the full length of said cleaning member in a lengthwise direction of said first cleaning frame member for supporting said cleaning member; and (iv) a second cleaning frame member coupled to said first cleaning frame member to close said second opening portion and to cooperate with said first cleaning frame member for constructing said removed developer containing portion; and (b) convey means for conveying the recording medium.

13. An electrophotographic image forming apparatus for forming an image on a recording medium, said electrophotographic image forming apparatus comprising:

(a) mount means for removably mounting a process cartridge onto a main body of said electrophotographic image forming apparatus, said process cartridge including:

(i) an electrophotographic photosensitive drum;

(ii) a developing member for supplying a developer to said electrophotographic photosensitive drum to develop a latent image formed thereon;

(iii) a cleaning member containing said electrophotographic photosensitive drum for removing any developer remaining thereon;

(iv) a developing frame for supporting said developing member;

(v) a first cleaning frame member pivotably connected to said developing frame, said first cleaning frame member having:

an exposure opening through which information light from said main body passes to irradiate said electrophotographic photosensitive drum when said process cartridge is mounted on said main body of said electrophotographic image forming apparatus;

photosensitive drum supporting portions provided on one end and the other end of said first cleaning frame member in a lengthwise direction thereof for supporting said electrophotographic photosensitive drum;

a first opening portion for directing the developer removed by said cleaning member to a removed developer containing portion;

a second opening portion opened in a direction faced upwardly when said process cartridge is mounted on said main body of said electrophotographic image forming apparatus;

a bottom portion provided to be located at a lower position when said process cartridge is mounted on said main body; and a cleaning member supporting portion for supporting said cleaning member, said cleaning member supporting portion being provided to extend substantially over a full length of said cleaning member in the lengthwise direction of said first cleaning frame member and to extend substantially from above to below when said process cartridge is mounted on said main body of said electrophotographic image forming apparatus; and (vi) a second cleaning frame member coupled to said first cleaning frame member to close said second opening portion and to cooperate with said first cleaning frame member to thereby constitute said removed developer containing portion; and (b) convey means for conveying the recording medium.

14. An electrophotographic image forming apparatus according to claim 12 or 13, wherein said electrophotographic image forming apparatus is an electrophotographic printer.

15. An electrophotographic image forming apparatus according to claim 14, wherein said electrophotographic printer is a laser beam printer.

16. An electrophotographic image forming apparatus according to claim 12 or 13, wherein said electrophotographic image forming apparatus is an electrophotographic facsimile apparatus.

17. An electrophotographic image forming apparatus according to claim 12 or 13, wherein said electrophotographic image forming apparatus is an electrophotographic copier.

18. A process cartridge removably mounted onto a main body of an electrophotographic image forming apparatus, said process cartridge comprising:

(a) an electrophotographic photosensitive member;

(b) a cleaning member contacting said electrophotographic photosensitive member for removing a toner remained thereon;

(c) a first cleaning frame including:

(i) an exposure opening through which information light from the main body passes to irradiate said electrophotographic photosensitive member when the process cartridge is mounted on the main body of the electrophotograhic image forming apparatus:

(ii) a photosensitive member support portion for supporting said electrophotographic photosensitive member;

(iii) a wall portion having a first opening for leading a developer removed by said cleaning member to a removed developer containing portion, said wall portion being disposed between said removed developer containing portion and a space where said electrophotographic photosensitive member is provided, from one end to the other end of said first cleaning frame in a longitudinal direction thereof; and (iv) a second opening opened in a direction crossing with a longitudinal direction in which said first opening is opened; and (d) a second cleaning frame coupled to said first cleaning frame so as to close said second opening and to cooperate with said first cleaning frame to thereby construct said removed developer containing portion.

19. A process cartridge according to claim 18, wherein said first cleaning frame and said second cleaning frame are coupled by an ultrasonic welding.

20. A process cartridge according to claim 19, wherein said first cleaning frame includes a charging member for charging said electrophotographic photosensitive member.

21. A process cartridge according to claim 18, wherein said cleaning member includes a cleaning blade contacting with electrophotographic photosensitive member and a blade supporting member supporting said cleaning blade, wherein said blade supporting member is attached to said wall portion so that said wall portion and said cleaning member cooperate to partition said removed developer containing portion and the space where said electrophotographic photosensitive member is provided.

22. A process cartridge according to claim 4, wherein said first cleaning frame member has a bottom portion which becomes lower when said process cartridge is mounted on the main body of said image forming apparatus, wherein said photosensitive member supporting portion is provided on one end and the other end of said first cleaning frame member, in a lengthwise direction thereof, and a wall portion is provided to extend substantially from above to below with said process cartridge mounted on the main body of the image forming apparatus.

23. A process cartridge according to claim 18 or 19, wherein at least one of charging means, for charging said electrophotographic photosensitive member, and developing means, for supplying the developer to said electrophotographic photosensitive member, said cleaning member and said electrophotographic photosensitive member are integrally made into a cartridge removably mountable onto said main body of said image forming apparatus.

24. A process cartridge according to claim 18, wherein said second opening is opened in a direction located upward when said process cartridge is mounted onto the main body of said image forming apparatus.

25. An electrophotographic image forming apparatus for forming an image on a recording medium, said electrophotographic image forming apparatus comprising:

(a) mount means for removably mounting a process cartridge onto a main body of said electrophotographic image forming apparatus, said process cartridge including:

(i) an electrophotographic photosensitive member;

(ii) a cleaning member contacting said electrophotographic photosensitive member for removing toner remained thereon;

(iii) a first cleaning frame including:

an exposure opening through which information light from said main body passes to irradiate said electrophotographic photosensitive member when said process cartridge is mounted on said main body of said electrophotographic image forming apparatus;

a photosensitive member supporting portion for supporting said electrophotographic photosensitive member;

a wall portion having a first opening for leading a developer removed by said cleaning member to a removed developer containing portion, said wall portion being disposed between said removed developer containing portion and a space where said electrophotographic photosensitive member is provided, from one end to the other end of said first cleaning frame in a longitudinal direction thereof; and a second opening opened in a direction crossing with a longitudinal direction in which said first opening is opened; and (iv) a second cleaning frame coupled to said first cleaning frame so as to close said second opening and to cooperate with said first cleaning frame to thereby construct said removed developer containing portion; and (b) a convey means for conveying the recording medium.

* * * * *

UNITED STATES PATENT AND TRADEMARK OFFICE

CERTIFICATE OF CORRECTION

PATENT NO. : 5,966,567

DATED : October 12, 1999

INVENTOR(S): HIROOMII MATSUZAKI ET AL.

It is certified that error appears in the above-identified patent and that said Letters Patent is hereby corrected as shown below:

ON THE COVER PAGE

At Section [57] Abstract

Line 2, "forming" should read --forming apparatus--.

COLUMN 2

Line 19, "Also, the" should read --Also, an--.

Line 63, "be" should be deleted.

Line 64, "come" should read --become--.

COLUMN 4

Line 42, "is" should read --are--.

COLUMN 5

Line 33, "$\mu$m±30" should read --$\mu$m ± 30--.

COLUMN 6

Line 34, "by a" should read --by--.

UNITED STATES PATENT AND TRADEMARK OFFICE

CERTIFICATE OF CORRECTION

PATENT NO. : 5,966,567

DATED : October 12, 1999

INVENTOR(S) : HIROOMII MATSUZAKI ET AL.

It is certified that error appears in the above-identified patent and that said Letters Patent is hereby corrected as shown below:

COLUMN 8

Line 48, "fox-shaped," should read --box-shaped--.

COLUMN 10

Line 33, "toy" should read --to--.

Line 65, "electrophotoraphic" should read --electrophotographic--.

Signed and Sealed this

Fifteenth Day of August, 2000

*Attest:*

Q. TODD DICKINSON

*Attesting Officer*

*Director of Patents and Trademarks*